US006685660B1

(12) United States Patent
Taverna et al.

(10) Patent No.: US 6,685,660 B1
(45) Date of Patent: Feb. 3, 2004

(54) MASSAGE VIBRATOR FOR THE RELIEF OF ACHES AND PAIN

(76) Inventors: Lucia Taverna, Via Varesina, 55, I-20156, Milan (IT); Luciano Marinelli, Via Roma, 10, Trav. 12, I-25049, Iseo (IT); Henry Bertoli, Via Valsorda, 47/A, I-52062, Concesio (IT); Louis Bertoli, Via Valsorda, 47/A, I-25062, Concesio (IT)

( * ) Notice: Subject to any disclaimer, the term of this patent is extended or adjusted under 35 U.S.C. 154(b) by 22 days.

(21) Appl. No.: 09/806,599

(22) Filed: Aug. 2, 2001

(30) Foreign Application Priority Data

Jul. 30, 1999 (IT) ..... BS99A0076

(51) Int. Cl.[7] ..... A61H 1/00

(52) U.S. Cl. ..... 601/81; 601/46; 601/133; 606/204

(58) Field of Search ..... 601/46, 48, 67–73, 601/78, 80–83, 89, 93–95, 133, 134, 135; 606/204

(56) References Cited

U.S. PATENT DOCUMENTS 1,577,924 A * 3/1926 Matchett ..... 601/103
2,688,960 A * 9/1954 Fischer ..... 601/71
5,018,511 A * 5/1991 Yokoi ..... 601/84
5,413,551 A * 5/1995 Wu ..... 601/46
5,519,292 A * 5/1996 Taylor et al. ..... 318/114
5,967,784 A * 10/1999 Powers ..... 433/229
6,158,439 A * 12/2000 Streetman ..... 128/898
6,174,298 B1 * 1/2001 Quinn et al. ..... 601/137

* cited by examiner

*Primary Examiner*—Nicholas D. Lucchesi
*Assistant Examiner*—Victor Hwang
(74) *Attorney, Agent, or Firm*—McGlew and Tuttle, P.C.

(57) ABSTRACT

This invention concerns a massage vibrator for the relief of various aches and pains in the head, face and body by means of stimulating energy channels and parts of the body surface. It has a central body (11), enclosing a vibration generator (16), at least one pair of springy arms (14) on one part of the central body and an active terminal head (15) at the end of each of these said arms, The terminal heads of each pair of arms are applied to the area to be stimulated and the vibrations produced by the vibrator are transmitted, through the springy arms, to the terminal heads (15) in order to exercise a massaging vibratory action at the point desired.

14 Claims, 3 Drawing Sheets

MASSAGE VIBRATOR FOR THE RELIEF OF ACHES AND PAIN

FIELD OF THE INVENTION

This invention proposes an electro-medical device as a massage vibrator, capable of acting positively on aches and pains to the head, face and body of a person.

STATE OF THE ART

Over thousands of years of application, traditional oriental medicine, Chinese in particular, has discovered how the stimulation of certain parts of the body surface can have a positive effect on disturbances, symptoms and illness of the internal organs and the various body zones. Among the numerous points discovered, some of the most important are, without doubt, the point of the energy channel of the large intestine and the large crossover of these channels. These points, situated between the thumb and the index finger of the hands, and at the base of the big toe, respectively, have not only a general influence on the vital energy, but are also effective, in particular, for all forms of aches and pains to the face and head, such as migraines headaches, toothaches and other body pains in general.

In the course of time, the treatment of acupuncture zones has become enriched by increasingly refined and sophisticated stimulation methods. From the primitive needles in stone and bone, things have moved on via needles of gold and silver, to those in steel used today. From stimulation by heat, we have arrived at stimulation by electricity, using magnetic impulses, and laser, as well as numerous other methods that are still in an experimental phase.

Manual micro-massage, which involves vibration of the energy points, has always been one of the most effective methods, and this consideration was behind the design of the massage vibrator of the present invention, where the mechanical action of deep and accurate compression of the points in question has been combined with vibration.

This combined action makes it possible to carry out mechanically a real and proper micro-massage, vibrating the specific points, without either pause or interruption due to the manual action of the operator, with highly effective results on the various aches and pains of the head, face and other parts of the body surface.

DESCRIPTION OF THE INVENTION

The massage vibrator which is proposed here consists of a central body that encloses a battery-powered vibration generator, a pair of springy arms on at least one, although better if both facing sides of the central body, and a head at the free end of each arm. Then, the vibrations produced by the vibrator inside the central body are transmitted, by means of the springy arms, to the active terminal heads, which, applied to the points for stimulation, exercise an effective vibrating massage for aches and pains.

The massage vibrator, therefore, represents a simple and easy-to-use device, since it may be handled, used and controlled independently by the patients themselves, without the need for an operator. It is a valid and modern response to those aches and pains, such as aches in the forehead, temples and crown of the head, migraines, toothache, shooting pains, cramps and soreness of the neck; against hair loss, anxiety, insomnia, worry, anger, etc., in order to relax generally.

BRIEF DESCRIPTION OF THE DRAWINGS

The invention will be described in greater detail below and with reference to the enclosed drawings, which are indicative but not binding, and where.

DETAILED DESCRIPTION OF THE INVENTION

Figure 1:
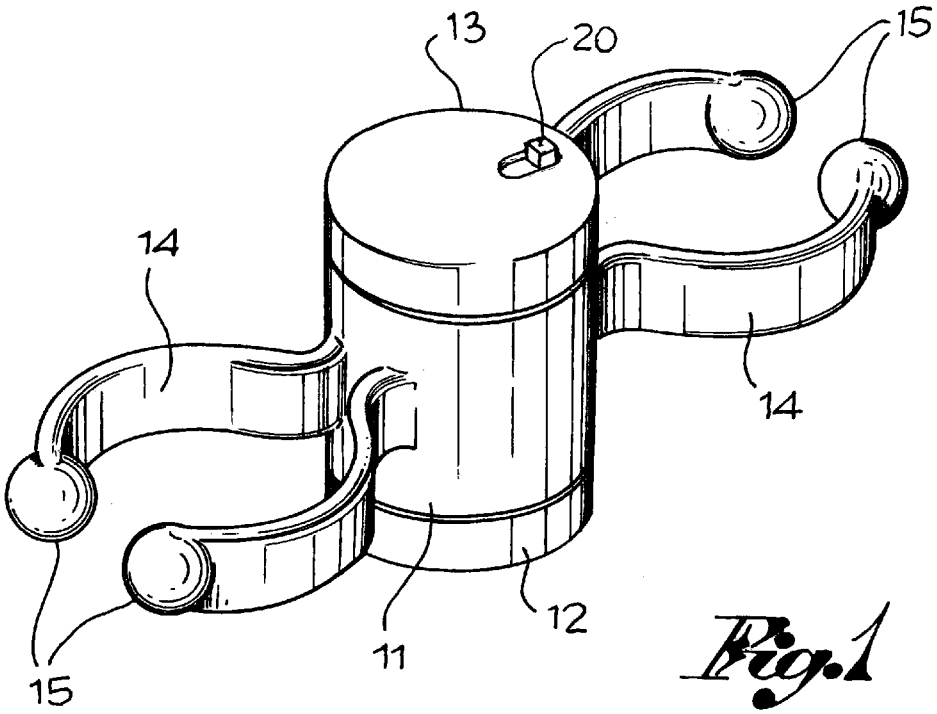
FIG. 1 shows a perspective of the device.

The device in question consists of a central body-container (11), made in plastic, with a fixed flange (12) at the bottom and a detachable lid (13) at the top. From both sides of the central body, or at least from one side, there are added two curved, springy arms (14), each equipped with an active terminal head (15). The curved arms of each pair are joined to the body, have their respective inner curves facing one another and curve towards each other at their free ends. The terminal head (15) of each arm (14) is preferably spherical, although this does not exclude other hemispherical, ellipsoidal, cylindrical shapes, etc., which may be deemed necessary.

Inside the body-container (11), there is housed and protected a vibration generator (16). This may be electromagnetic or, as shown here, a cam (19) with a motor driven electrically by two batteries (17), for example 1.5 V alkaline batteries. There is a support spring for each battery and, inside the lid, there are contacts (18) for opening and closing tile electrical circuit of the vibrator generator, as a result of a twisting or axial movement of the lid, or by means of a switch (20).

Figure 4:
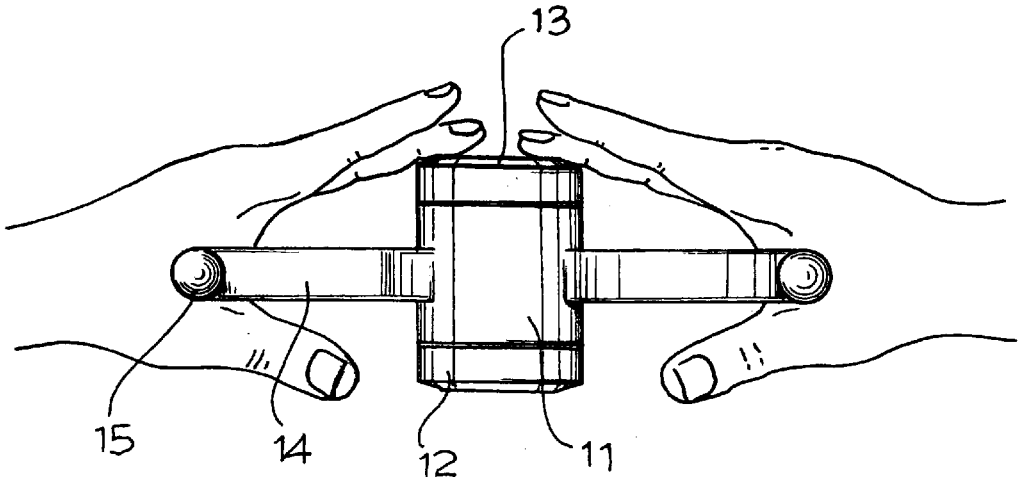
FIG. 4 shows a side view of the device in use.
Figure 2:
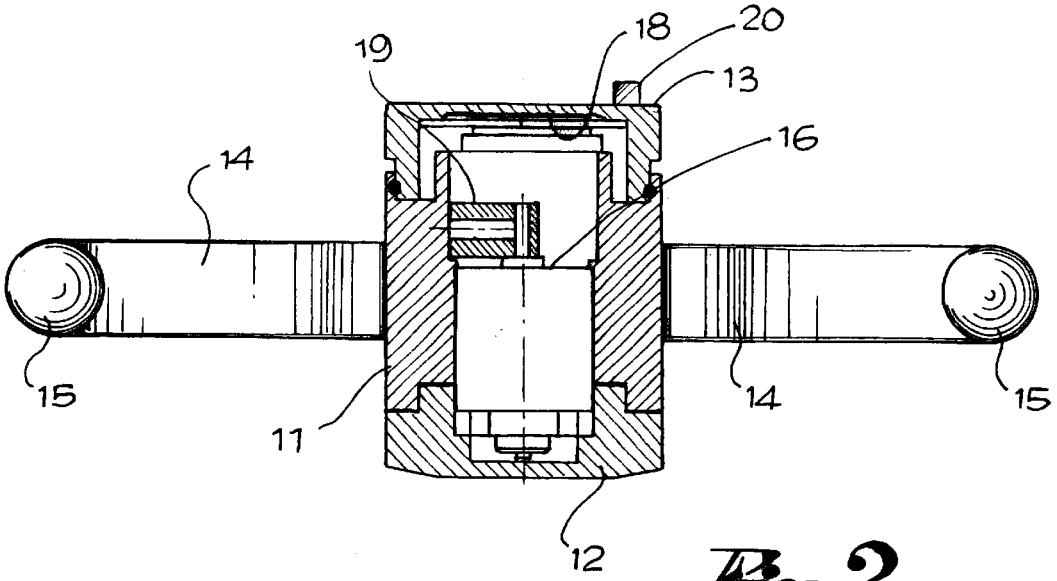
FIG. 2 shows a side view in cross-section of the device in FIG. 1.
Figure 3:
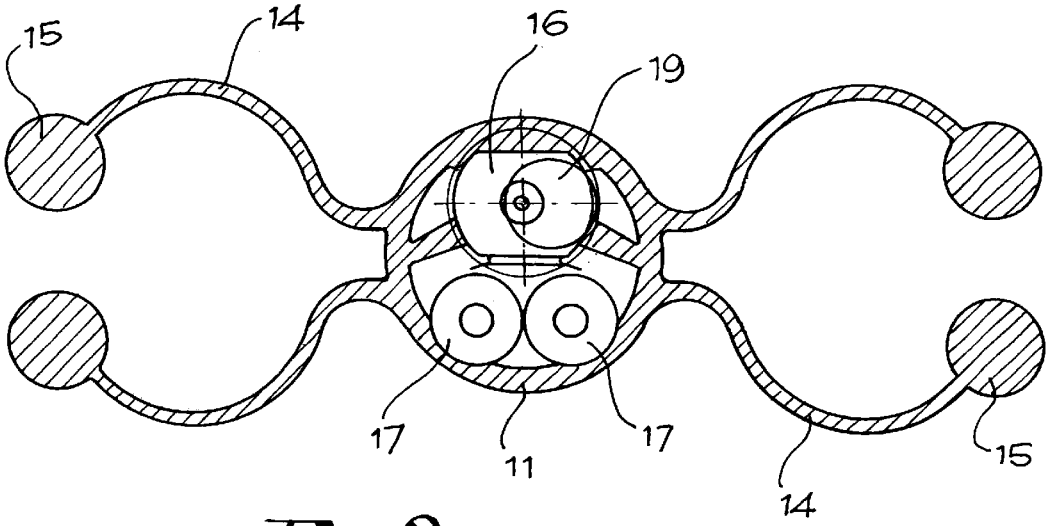
FIG. 3 shows a horizontal cross-section of the device.
Figure 6:
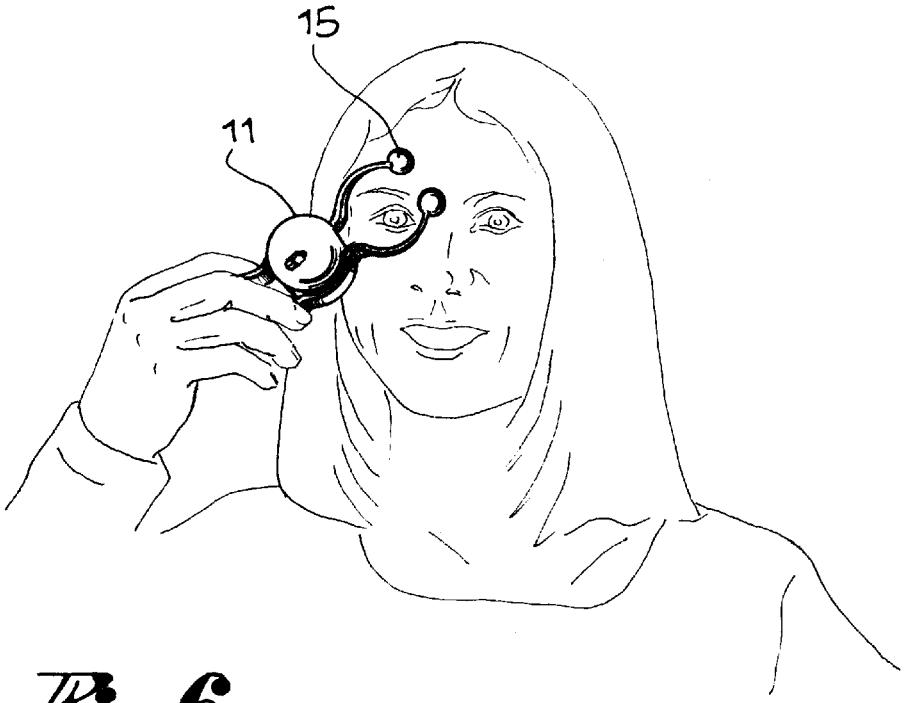
FIGS. 5 and 6 show other different ways of using the device.
Figure 5:
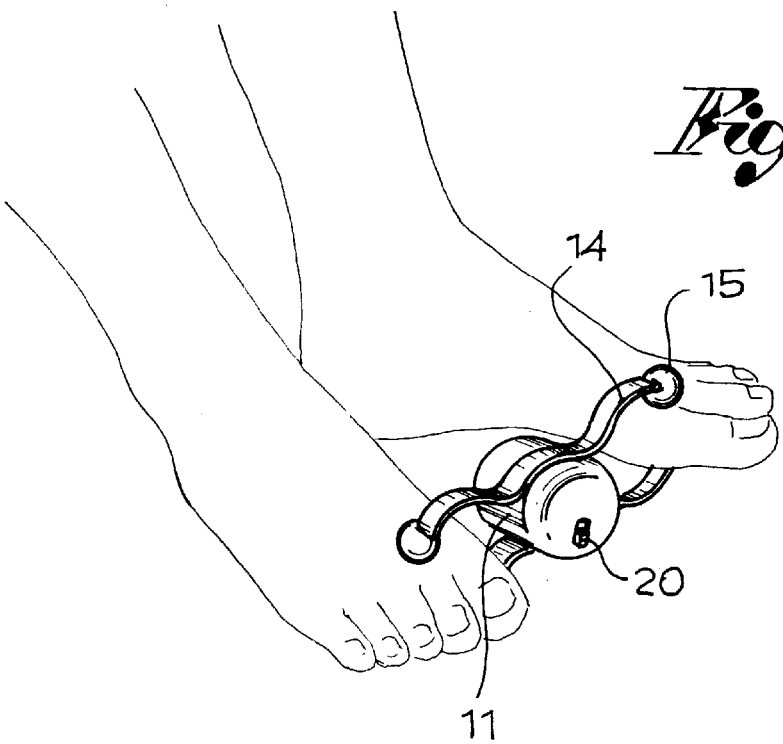

As shown in FIGS. 4 and 5, the device can be taken and used directly by the patient applying the terminal heads (15) of the springy arms (14) to the points on the hand to be stimulated, and moving the lid in order to start up the vibrator generator (16), as needed. In this way, the vibrations are transmitted to the points for stimulation with a vibratory massage action that produces the above-mentioned beneficial effects.

What is claimed is:

1. A massage vibrator for the effective relief of aches and pains in the head, face and body, the massage vibrator comprising:

a central body container;

batteries;

a vibration generator, said central body container enclosing said vibration generator for vibration of said central body container as a whole, said central body container enclosing said batteries with said vibration generator powered by said batteries;

springy arms extending a distance in opposed facing relationship as a springy arm pair on a side of the central body, the springy arms being vibrated along with said central body; and an active terminal head at the end of each of said springy arms and provided supported by said springy arm pairs as terminal head pairs with each active terminal head on one of said springy arms supported facing another active terminal head on another of said springy arms, the terminal heads being applied to a point to be stimulated, vibrations produced by the massage vibrator in said central body container being transmitted, via the springy arms, to said terminal heads in order to exercise a vibratory massage on the point.

2. A massage vibrator according to claim 1, in which said springy arms are joined to the central body and have a curved shape, with inner curved sides of the curved shape facing and opposite each other and with free ends, with the connected active terminal heads curving towards each other.

3. A massage vibrator according to claim 2, in which each active terminal head is either spherical, ellipsoidal, cylindrical or other in shape.

4. A massage vibrator according to claim 2, in which the central body is furnished with an electric switch for turning the vibration generator on and off as needed, said switch being either on the top or consisting of a rotating lid on said body.

5. Massage vibrator according to claim 2, in which the vibration generator is an electrically-driven cam.

6. A massage vibrator according to claim 1, in which each active terminal head is one of a spherical, ellipsoidal or cylindrical shape.

7. A massage vibrator according to claim 6, in which the central body is furnished with an electric switch for turning the vibration generator on and off as needed, said switch being either on the top or consisting of a rotating lid on said body.

8. Massage vibrator according to claim 6, in which the vibration generator is an electrically-driven cam.

9. A massage vibrator according to claim 1, in which the central body is furnished with an electric switch for turning the vibration generator on and off as needed, said switch being either on the top or consisting of a rotating lid on said body.

10. A massage vibrator according to claim 9, in which the vibration generator is an electrically-driven cam.

11. A massage vibrator according to claim 1, in which the vibration generator is an electrically-driven cam.

12. A massage vibrator according to claim 1, wherein said first springy arm has a curved shape to support said first springy arm directed toward and facing said second active terminal head and said second springy arm has a curved shape to support said second springy arm directed toward and facing said second active terminal head, said curved shape of said first springy arm being opposite said curved shape of said second springy arm with each of said first springy arm and said second springy arm curving towards each other.

13. A method for stimulating points on a body surface, the method comprising:

stimulating the point in question with a vibratory massage action;

generating the vibratory massage using active terminal heads connected to a central body container enclosing a vibration generator by vibrating the central body container as a whole with the vibrating generator and vibrating the active terminal heads via springy arms extending a distance in opposed facing relationship from the central body container and holding the terminal heads at the end of each of the springy arms as a terminal head pair with each active terminal head on one of the springy arms supported facing another active terminal head on another of the springy arms for transmitting the vibration produced by the vibrator via the springy arms to the terminal heads in order to exercise a vibratory massage on the chosen point.

14. A massage vibrator for the direct stimulation of the energy channels and other points on a body surface, the massage vibrator comprising:

a central body container;

batteries;

a vibration generator, said central body container enclosing said vibration generator for direct vibration of said central body container as a whole, said central body container enclosing said batteries with said vibration generator powered by said batteries;

a first springy arm connected integrally to said central body container;

a second springy arm connected integrally to said central body container, said first springy arm and said second springy arm extending a distance together in a direction as a springy arm pair in opposed facing relationship from a side of said central body container, the springy arms being vibrated along with said central body container;

a first active terminal head connected to an end of said first springy arm; and a second active terminal head connected to an end of said second springy arm said first active terminal head being supported by said first springy arm directed toward and facing said second active terminal head and said second active terminal head being supported by said second springy arm directed toward and facing said first active terminal head to provide a closely spaced terminal head pair defining an application gap therebetween for application to the point to be stimulated, the vibrations produced by the vibrator in said body being transmitted, via the springy arms, to said terminal heads in order to exercise a vibratory massage on the chosen point arranged in the gap.

* * * * *